US005692472A

United States Patent [19]

Bederna et al.

[11] Patent Number: 5,692,472

[45] Date of Patent: Dec. 2, 1997

[54] METHOD AND ARRANGEMENT FOR CONTROLLING THE DRIVE UNIT OF A MOTOR VEHICLE

[75] Inventors: Frank Bederna, Korntal-Müchingen; Martin Streib, Vaihingen; Thomas Zeller, Ditzingen, all of Germany

[73] Assignee: Robert Bosch GmbH, Stuttgart, Germany

[21] Appl. No.: 722,681

[22] Filed: Sep. 30, 1996

[30] Foreign Application Priority Data

Sep. 28, 1995 [DE] Germany ..... 195 36 038.9

[51] Int. Cl.[6] ..... F02D 41/00

[52] U.S. Cl. ..... 123/350

[58] Field of Search ..... 123/350, 351, 123/352, 478, 480, 445, 446, 491, 399, 474, 492; 180/197

[56] References Cited

U.S. PATENT DOCUMENTS

| | | | |
|---|---|---|---|
| 4,603,675 | 8/1986 | Junginger et al. | 123/478 |
| 5,048,482 | 9/1991 | Kratt et al. | 123/333 |
| 5,069,181 | 12/1991 | Togai et al. | 123/399 |
| 5,245,966 | 9/1993 | Zhang et al. | 123/339 |
| 5,282,449 | 2/1994 | Takahashi et al. | 123/350 |
| 5,391,127 | 2/1995 | Nishimura | 123/350 |

*Primary Examiner*—Raymond A. Nelli
*Attorney, Agent, or Firm*—Walter Ottesen

[57] ABSTRACT

The invention is directed to a method and an arrangement for controlling the drive unit of a motor vehicle. The maximum permissible torque or the maximum permissible power is determined and fault reactions are initiated when the limit value is exceeded by a computed actual torque value or an actual power value.

11 Claims, 4 Drawing Sheets

METHOD AND ARRANGEMENT FOR CONTROLLING THE DRIVE UNIT OF A MOTOR VEHICLE

BACKGROUND OF THE INVENTION

U.S. Pat. No. 4,603,675 discloses a method and an arrangement for controlling the drive unit of a motor vehicle. In this method and arrangement, the power of the drive unit is determined via an electric adjustment of the throttle flap of an engine in dependence upon the command of the driver pregiven by the adjustment of the accelerator pedal. It is especially necessary to consider operational reliability because, in this system, the drive power of the drive unit is adjusted only via an electrical path. For this reason, the method and arrangement disclosed in U.S. Pat. No. 4,603,675 provide that the setting of the accelerator pedal and therefore the driver command is compared to the position of the throttle flap. An erroneous operation of the equipment is assumed and a corresponding reaction initiated if the difference between the two values exceeds a predetermined limit value. If required, this difference can be after a pregiven filter time. This monitoring concept is predicated on a certain coupling between the position of the accelerator pedal and the position of the throttle flap. In modern engine controls, a complete decoupling between accelerator pedal and throttle flap for new functions such as lean concepts or catalytic converter heating functions can be an objective. If this is the case, then the known monitoring concept is applicable only with difficulty in at least several operating regions.

U.S. Pat. No. 5,558,178 discloses adjusting an input value for the torque to be outputted by the drive unit or the power to be generated thereby. In this context, an estimate of this torque or this power is described and, if required, while also considering the internal losses as well as the operating state of ancillary consumers. In the engine described herein, the input value is adjusted by controlling the following: the air supply, the fuel metered and/or the ignition angle. The actual torque or the actual power is computed on the basis of engine rpm, motor load (air mass) and the actual adjustment of the ignition angle. If required, this is supplemented by considering the internal friction losses as well as the operating state of ancillary consumers.

SUMMARY OF THE INVENTION

In view of the foregoing, it is an object of the invention to provide measures for monitoring the control of a drive unit which is easily applied even when there is a complete decoupling between driver command and the actuating element or elements which adjust the drive power.

The method of the invention is for controlling the drive unit of a vehicle. The method includes the steps of: adjusting the torque and output power of the drive unit via an electrical path in dependence upon a first operating variable defining the position of an operator-actuated element actuated by the driver of the vehicle; supplying the first variable and additional operating variables to an electronic control unit; computing the torque and power of the drive unit in dependence upon the operating variables utilizing the electronic control unit; determining the maximum permissible torque and the maximum permissible power utilizing the electronic control unit; and, initiating a fault reaction when the computed torque and power exceed the maximum permissible torque and the maximum permissible power.

The solution provided by the invention makes possible a reliable monitoring of the control of the drive unit in all operating states and even in the presence of a complete decoupling of the position of the accelerator pedal and engine power.

In this way, the operating reliability of the control is ensured also in those operating states wherein the power deviates from the input via the accelerator pedal (for example, for heating of the catalytic converter in the cold start with a retarded ignition angle and increased air supply and for lean operation of the engine with increased air supply compared to a $\lambda=1$ operation and for power increasing measures such as engine drag torque control et cetera).

Monitoring is made significantly more precise by considering the ignition angle because the ignition angle significantly affects the efficiency of the engine. The consideration of the ignition angle becomes advantageous especially for catalytic converter heating measures via retarded ignition angle with a simultaneous increase of the supplied air.

Furthermore, and in contrast to the known position comparison, tolerances in the characteristic of the angle sensors, which affect the precision of the comparison, do not have to be considered.

Influences caused by charging (such as via a turbo charger), which operate on the power of the engine, are automatically taken into account by considering the actual air/fuel mixture drawn by the engine for the monitoring of the control of the drive unit.

It is especially advantageous that the solution provided by the invention can be utilized for the drive unit for different embodiments of the control arrangement. In these embodiments, individual functions can be executed separately from each other.

Monitoring on the basis of torque values or power values is especially advantageous because these values are determined via an engine simulation and can be checked in this manner irrespective of whether the driver command has been converted into the correct power or into the correct torque.

It is especially advantageous to carry out monitoring during idle of the drive unit because, in this operating state, an increased power can be especially critical. Outside of idle, a driver would react to increased power by releasing the accelerator pedal.

BRIEF DESCRIPTION OF THE DRAWINGS

The invention will now be described with reference to the drawings wherein.

DESCRIPTION OF THE PREFERRED EMBODIMENTS OF THE INVENTION

Figure 1:
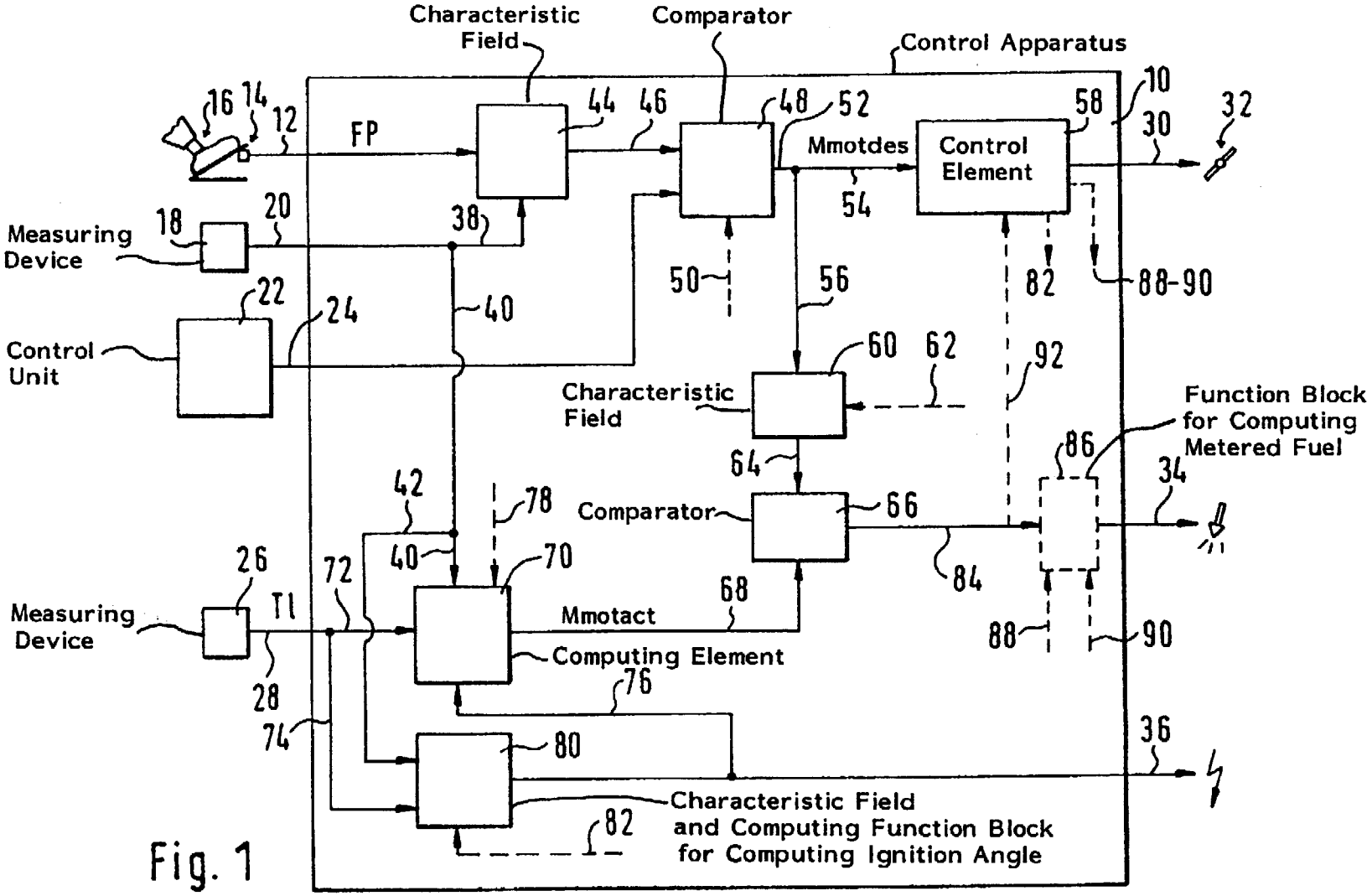
FIG. 1 is an overview block function diagram of the arrangement according to the invention.

FIG. 1 shows an overview block circuit diagram of a control apparatus 10 as it can be configured in the arrangement according to the invention. The control apparatus 10 includes a microcomputer having subprograms or program steps which are shown as function blocks in FIG. 1. For reasons of clarity, only those elements are shown which are needed to explain the solution of the invention. The control apparatus 10 includes all the elements which are needed according to the state of the art to control a drive unit and preferably an internal combustion engine.

At least one input line 12 from at least one measuring device 14 is connected to the control apparatus 10 or microcomputer. The measuring device 14 detects the position of an operator-controlled element 16 actuated by the driver. An input line 20 connects an rpm measuring device 18 to the control apparatus 10 and a line 24 connects a control unit 22 to the control apparatus 10 and a line 28 connects a measuring device 26 to the control apparatus 10. The control unit 22 can, for example, control the engine drag torque. The line 28 connects measuring device 26 for detecting the engine load, for example, from an air-quantity sensor, an air mass sensor, a throttle flap position sensor or a sensor for detecting intake pipe pressure or combustion chamber pressure or the quantity of fuel injected.

In the preferred embodiment, the control apparatus 10 influences the air supply to an internal combustion engine via at least one output line 30. The control apparatus 10 can influence the air supply to the engine via an electrically actuable throttle flap 32 and the metered fuel and the ignition of the engine via the output lines 34 and 36, respectively.

The input line 12 and the input line 20 are connected to a characteristic-field element 44. The input line 20 branches into the lines 38, 40 and 42. The output line 46 of the characteristic-field element 44 leads to a comparator element 48. The input line 24 and, if needed, at least one further input line 50 (shown dotted in FIG. 1) is connected to the comparator element 48. The output line 52 of the comparator element 48 branches into a line 54 and into a line 56. The line 54 is connected to the control element 58 having an output line representing at least the output line 30 of the control apparatus.

In addition, the element 58 influences the metering of fuel via the line 82 and/or the ignition angle via lines 88 to 90. The line 56 is connected to a characteristic line or characteristic-field element 60. At least one further operating variable such as the engine rpm is supplied to the element 60, as required, via at least one line 62 (shown as a broken line). The output line 64 of the element 60 is connected to a second comparator element 66. A line 68 is connected to the comparator element 66 which defines the output line of a computing element 70. The line 40 connects as an input line to the computing element 70 and branches off the line 20. The line 72 is connected to the computing element 70 and branches off line 28. A line 76 is also connected to the computing element 70 and, in an advantageous embodiment, at least one further line 78 (shown as a broken line) is also connected to computing element 70. The line 76 branches from line 36 for influencing the ignition angle. The line 36 is the output line of a characteristic field and computing element 80 which, in turn, has input line 42 and the line 74 branching from line 28 as well as at least one further line 82 (shown as a broken line).

For influencing the metering of fuel, the output line 84 of the comparator element 66 is connected to an element 86 (shown by a broken line) for computing the metered fuel. At least input lines 88 to 90 are connected to the element 86 and the output line thereof is shown as line 34. In an advantageous embodiment, and as alternative or supplementary, a line 92 branches from the output line 84 and is connected to control element 58.

The basic idea of the monitoring measures provided by the invention is that, in the context of engine simulation, a check is made as to whether the control system converts the pregiven desired value into the correct power. In this motor simulation, all data which are relevant to engine power and which are available, are considered. The desired value is pregiven by the driver or from additional control systems (engine drag torque control, idle control, et cetera).

In the preferred embodiment, the engine simulation takes place in the context of the estimate of the engine torque outputted or generated by the drive unit or the power which is generated by the drive unit (while considering the rpm) or the power which is outputted by the drive unit. The computed or estimated actual value is compared to a limit value derived from the driver command (driver input or input value of an additional control system). A fault is detected when the actual value exceeds the limit value.

A preferred embodiment is shown in FIG. 1 for the control of an internal combustion engine wherein the torque of the engine is adjusted in accordance with a pregiven desired torque as disclosed in U.S. Pat. No. 5,558,178 and incorporated herein by reference. For this purpose, a measured variable representing the position of the accelerator pedal as well as a variable representing the engine rpm are supplied to the characteristic-field element 44. There, a characteristic field is stored which, from the supplied signal quantities, determines a desired torque pregiven by the driver and outputs the desired torque via the line 46. With the determination of the desired torque, additional data such as data relative to gear position, vehicle road speed, et cetera, can be used in the determination of the desired torque. The characteristic field, which is utilized to form the driver desired torque value, is predetermined in accordance with the desired driving performance and with the power capacity of the vehicle.

Modern control systems for motor vehicles exhibit functions which reduce the engine torque independently of the input of the driver (for example, drive slip control, transmission control et cetera) or increase the engine torque (for example, engine drag torque control, idle control et cetera). Only the last mentioned are of interest with respect to the monitoring measures according to the invention. For this reason, a maximum value selection is determined between the supplied variables for forming the actual torque desired value (Mdes) in the comparator element 48. The largest value from this maximum value selection is outputted via the line 52. The desired torque value determined in this manner is translated by the control unit 58 in accordance with the known procedure primarily into the adjustment of the air supply and, if required, while correcting the fuel injection (one of the lines 88 to 90) and the ignition angle (one of the lines 82).

To compute the actual torque value, and as in the known state of the art, at least the signal, which represents the engine load, the engine rpm as well as the actual adjusted ignition angle are considered. In addition, and in an advantageous manner, the number of active cylinders is also considered in the determination of the actual torque.

If the comparison of the input torque and the actual torque is not made on the basis of the indicated torque (that is, the torque generated by the engine via combustion), and is instead made on the basis of the torque (clutch torque) outputted by the drive unit, then the following is considered in an advantageous manner and in addition to the above-mentioned variables: variables which influence the outputted torque such as the friction torque of the engine (which is temperature and rpm dependent) or the torque requirement of ancillary equipment (climate control system, windshield heating, et cetera).

The determined desired torque value is supplied to the characteristic line (characteristic field) 60 for monitoring purposes. There, a maximum permissible engine torque is stored as a limit value in dependence upon the input value. This limit value is then the basis of the comparison to the computed actual torque. In an advantageous manner, the engine rpm is also considered (line 62). This is done preferably in that, for engine rpms in the region of idle rpm or lower, the maximum permissible engine torque is comparatively greater than at higher -engine rpms. For this reason, the flexibility of the monitoring measures for a vehicle at standstill or a rolling vehicle is significantly increased because, especially in this range, via idle control and additional ancillary functions (such as catalytic converter heating measures), an actual torque can occur which deviates significantly from the driver command (at idle this torque is as a rule 0). In general, the limit value increases with increasing engine rpm.

A corresponding signal is transmitted via the line 84 when the determined actual torque exceeds the maximum permissible engine torque. This signal is considered in the computation of the metering of fuel by switching off the metering of fuel to individual cylinders or to all cylinders and/or is considered in the control unit 58 which cuts off the current of the actuator for the throttle flap or limits the position of the throttle flap. This computation is shown symbolically in FIG. 1 by the block 86.

The determination of ignition angle is represented symbolically by block 80 and determines, in a manner known per se, the ignition angle to be adjusted from the following: engine load, engine rpm, corrected interventions such as knock control, ignition angle correction via control unit 58, catalytic converter heating measures et cetera. The ignition angle to be adjusted is considered via the line 76 for the determination of the actual engine torque.

Figure 2:
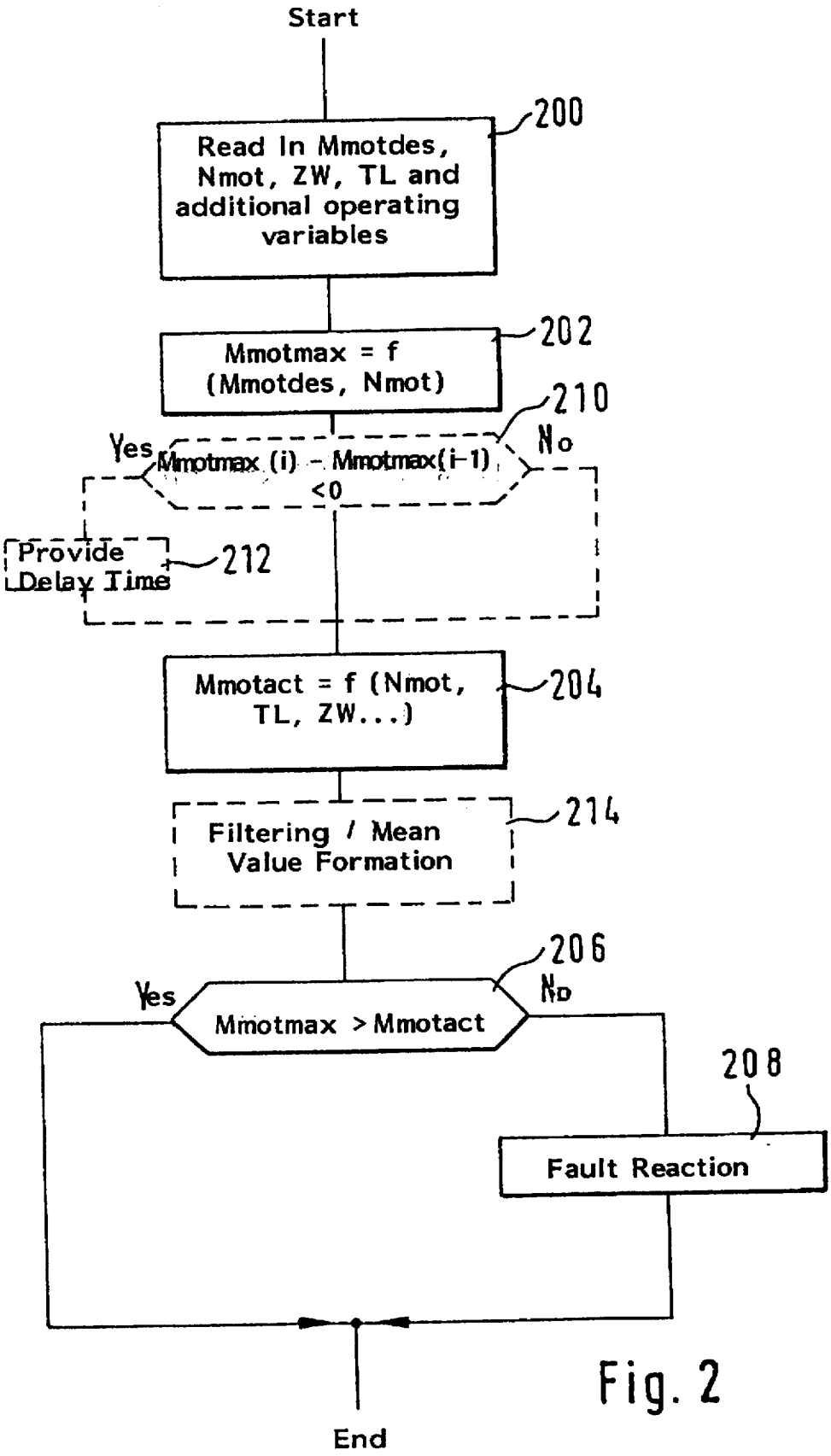
FIG. 2 is a flowchart to show how the solution of the invention can be realized in the context of a computer program.

To improve the function of the monitoring measures, the fault reaction measures are only initiated when the actual value has exceeded the desired value for a pregiven time duration. This is shown in the flowchart of FIG. 2. In addition, and to provide improvement when negative torque changes take place (that is, when the driver releases the accelerator pedal), it is provided that a time-dependent delay or a dead time element is effective when there is a change of the permissible torque in the direction toward lower values.

In addition to the embodiment shown which operates on the basis of engine torque, the motor control is carried out on the basis of power values in other advantageous embodiments. The measures undertaken then correspond because the interrelationship between engine torque and engine power is given by the engine rpm. Furthermore, and in other embodiments, a conventional position control of the throttle flap can also be carried out in dependence upon position desired values. In these conventional control concepts, the monitoring measures of the invention are determined by determining the desired torque values from the input values (especially from the accelerator pedal position) and the actual torque values as shown above and the desired and actual values of torque are compared to each other.

The flowchart of FIG. 2 shows how the solution of the invention can be realized as a computer program. After the start of the subprogram at pregiven time points, operating variables are read in in the first step 200. These operating variables preferably include the engine torque desired value Mdes, the engine rpm Nmot, the actual adjusted ignition angle ZW, the determined engine load TL and, as required, further operating variables (engine temperature, status of ancillary equipment, et cetera).

In the next step 202, and in the preferred embodiment, the maximum permissible engine torque Mmotmax is formed from the preprogrammed characteristic field in dependence upon engine desired torque Mmotdes and engine rpm Nmot. Thereafter, in step 204, and in accordance with the procedure known from the state of the art, the actual torque value Mmotact is computed in accordance with engine rpm, engine load, ignition angle and, if required, additional operating variables. In the next inquiry step 206, a check is made as to whether the maximum permissible torque value Mmotmax is greater than the determined torque actual value Mmotact. If this is the case, the subprogram is ended and repeated at a pregiven time. If the actual torque value exceeds the permissible value for a pregiven time, then, in accordance with step 208, fault reaction measures are initiated. These measures can include, for example, fuel interruption, cylinder suppression, limiting or cutting off the air supply et cetera. The subprogram is ended after step 208.

In the preferred embodiment, after step 202, inquiry step 210 provides inquiring as to the direction of the change of the maximum permissible engine torque. This takes place with respect to determined maximum values of two sequential program runthroughs. Alternatively, the change of the accelerator pedal position or the desired torque can be applied. If the maximum permissible engine torque becomes less (that is, the actual value is less than the previous value), a dead time or delay time in accordance with step 212 is provided before the program continues with step 204.

A further advantageous embodiment and for the determination of the actual engine torque in step 204, a filtering or a mean value formation of the determined values is undertaken in correspondence to step 214 in order to further increase the reliability and precision of the monitoring measure.

In an advantageous embodiment, the accelerator pedal position is detected via redundant sensors on the accelerator pedal. Both sensor data are supplied to the control apparatus 10. In the preferred embodiment, one of the pieces of sensor data is used to determine the desired torque value and to control the air supply and, if necessary, the metering of fuel and/or the ignition angle; whereas, from the remaining sensor data, the maximum permissible torque value, which is applied for monitoring, is determined.

Furthermore, in an advantageous embodiment, it is provided that the check only takes place at one operating point, namely, at idle. In the case where the accelerator pedal is released, the maximum permissible torque value is determined and compared to the determined actual torque value.

In a preferred embodiment, monitoring, however, takes place at every operating point of the engine. However, it is possible to input only selected operating points or operating ranges (for example, in the idle range, in the pregiven part-load range and/or in the full-load range). When these operating points or ranges are reached, the monitoring measures are carried out.

Figure 3A:
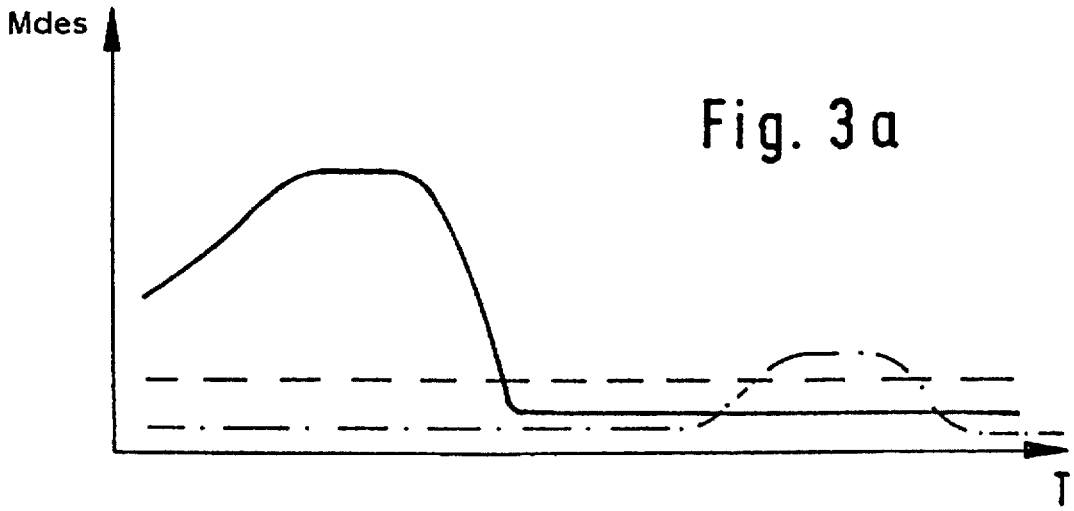
FIGS. 3*a* and 3*b* show the operation of the invention with respect to exemplary signal traces; and, FIG. 4 is a schematic showing different embodiments of the control arrangement.
Figure 3B:
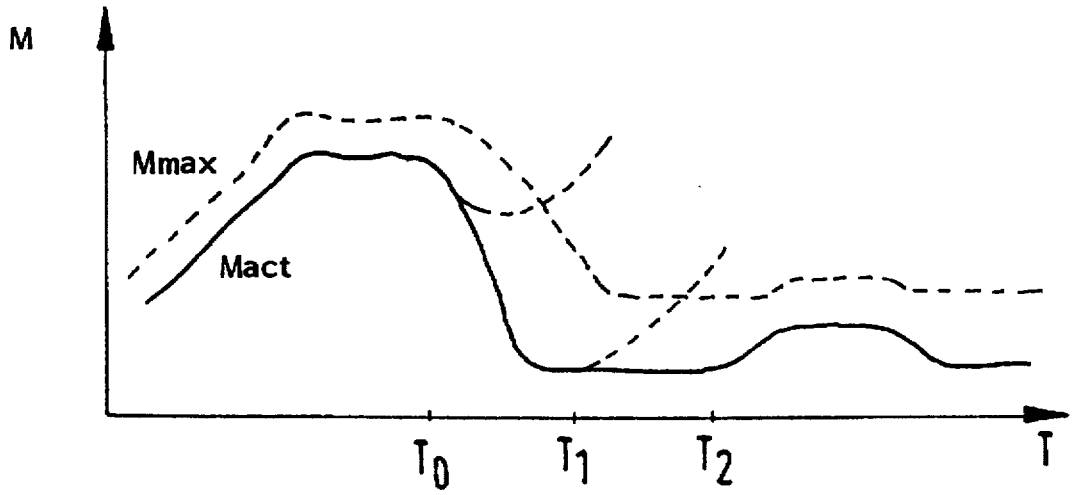

In FIGS. 3*a* and 3*b*, the solution provided by the invention is explained further with reference to exemplary signal traces. In FIG. 3*a*, the following pregiven desired torque values are shown: from the driver (solid line), from the idle controller (dash line) and from the engine torque controller (dot-dash line). FIG. 3*b* shows the computed actual value (solid line) as well as the maximum permissible torque (dotted line).

FIGS. 3*a* and 3*b* show how the driver accelerates the motor vehicle to the desired speed by actuating the accelerator pedal. Thereafter, the accelerator pedal is released and the vehicle is in overrun operation during which the engine drag torque controller increases the output torque of the engine. The release of the accelerator pedal at time $T_0$ leads to a rapid reduction of the actual torque; whereas, the maximum desired torque tracks with a delay.

In FIG. 3*b*, two operating situations are introduced in which a fault occurs. The first operating situation is after the release of the accelerator pedal when the engine power has suddenly again increased. The engine power exceeds the maximum permissible torque so that at time point $T_1$ and after a pregiven time has elapsed, the fault reaction measures are initiated. The other operating situation shows the vehicle in idle. Here, the engine torque exceeds the maximum permissible value so that at time point $T_2$ a fault reaction takes place after the elapse of a pregiven time.

Figure 4:
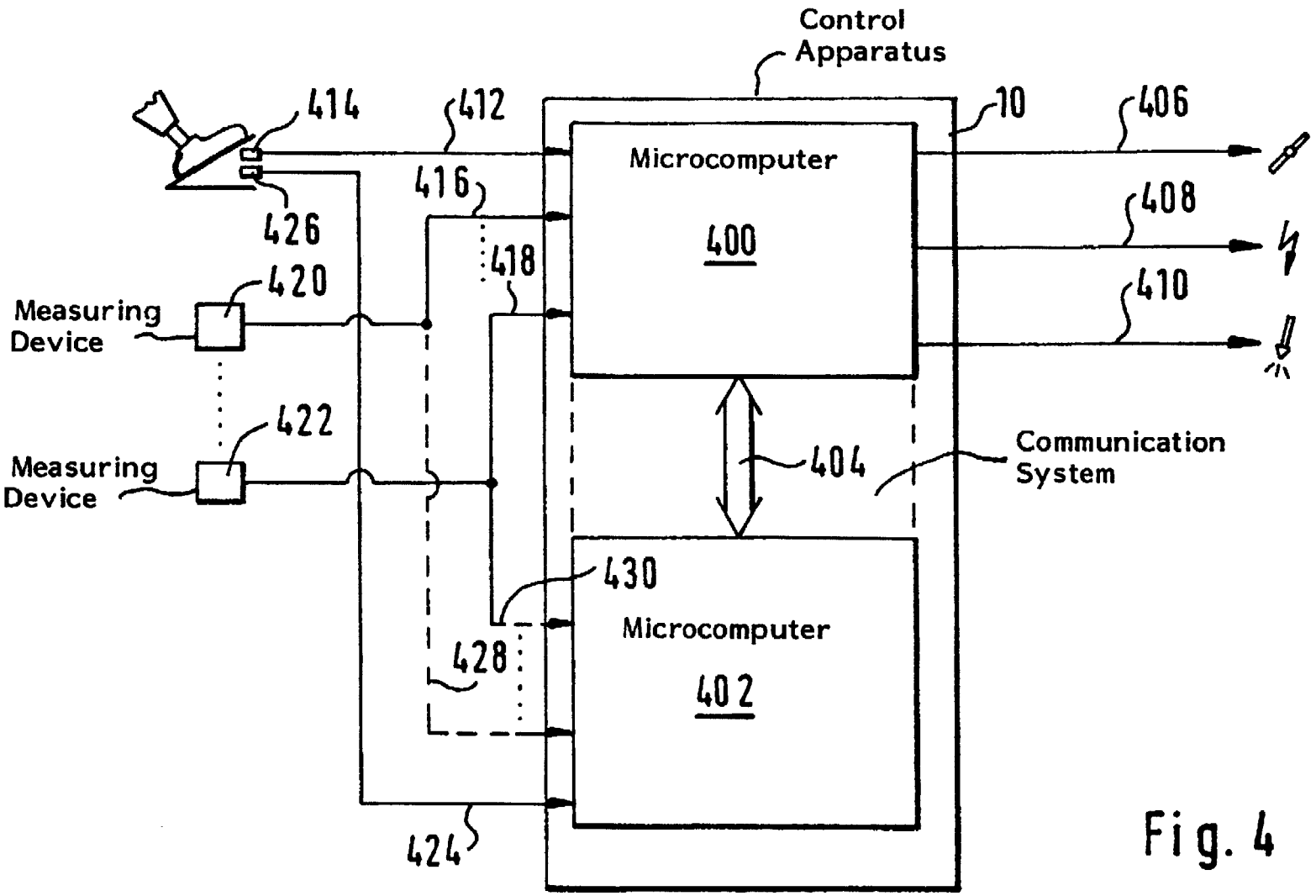

FIG. 4 shows embodiments of the control apparatus 10.

In the first embodiment, the control apparatus 10 comprises two microcomputers 400 and 402 which are interconnected via a communication system 404 for mutually exchanging data and information. The microcomputer 400 adjusts the air supply, the ignition and the fuel metering via output lines 406, 408 and 410, respectively.

A first measuring device 414 for detecting the accelerator pedal position is connected via input line 412 to the microcomputer 400. Also, measuring devices 420 to 422 for detecting the operating variables known from FIG. 1 are connected to the microcomputer 400 via input lines 416 to 418, respectively.

In the microcomputer 400, all functions needed to control the internal combustion engine are carried out, that is, fuel metering, ignition angle and the adjustment of the air supply in dependence upon operating variables which are read in. The second microcomputer 402 operates to carry out the monitoring measures according to the invention. For this purpose, a second sensor 426 detects the accelerator pedal position and is connected via input line 424 to the microcomputer 402. In a first preferred embodiment, the lines 428 to 430, which are branched from input lines 416 to 418, respectively, are also connected to the second microcomputer 402.

In this embodiment, the microcomputer 402 executes all monitoring measures including the determination of the actual torque value and the maximum permissible torque value as well as the comparison of the torque values. The fault data is transmitted via the communication system to the first microcomputer which executes the reaction.

The input lines 428 and 430 are omitted in another embodiment. In this other embodiment, the microcomputer 400 computes the actual torque and transmits this value via the interface 404 to the microcomputer 402. The microcomputer 402 forms the maximum permissible engine torque from the driver command signal and executes the comparison of the torque values. Alternatively, the microcomputer 402 transmits the operating variables to the second microcomputer which determines the actual torque.

In a further advantageous embodiment, the two microcomputers are combined and have mutually separate program blocks. Here too, in a first embodiment, all information is read into the two program blocks 400 and 402. Also, the possibility is provided that the operating variables for determining the actual torque are read in only by program block 400. This program block 400 then transmits these variables or the determined actual torque or both to the program block 402.

In all embodiments, any hardware and software errors of the computer element 400 as well as of the periphery (measuring devices and actuators) can be detected with the aid of the invention.

The solution provided by the invention can be applied advantageously to spark-ignition engines as well as to diesel engines or electric vehicles.

It is understood that the foregoing description is that of the preferred embodiments of the invention and that various changes and modifications may be made thereto without departing from the spirit and scope of the invention as defined in the appended claims.

What is claimed is:

1. A method for controlling the drive unit of a vehicle, the method comprising the steps of:

adjusting the torque and output power of the drive unit via an electrical path in dependence upon a first operating variable defining the position of an operator-actuated element actuated by the driver of the vehicle;

supplying said first variable and additional operating variables to an electronic control unit;

computing the torque and power of said drive unit in dependence upon said operating variables utilizing said electronic control unit;

determining the maximum permissible torque and a maximum permissible power utilizing said electronic control unit; and, initiating a fault reaction when said computed torque and power exceed said maximum permissible torque and said maximum permissible power.

2. The method of claim 1, wherein said maximum permissible torque or said maximum permissible power is determined on the basis of said first operating variable.

3. The method of claim 2, wherein said fault reaction is initiated when said maximum permissible torque or said maximum permissible power is exceeded for a time longer than a pregiven time interval.

4. The method of claim 1, the method comprising the further step of applying an averaged or filtered value for said computed torque or said computed power.

5. The method of claim 1, the method comprising the further step of applying the inducted air mass and/or the injected fuel quantity for computing said torque and said power of said drive unit.

6. The method of claim 1, the method comprising the further step of utilizing the adjusted angle of the throttle flap for computing said torque and said power of said drive unit.

7. The method of claim 1, wherein said additional operating variables include the ignition angle.

8. The method of claim 5, wherein said additional operating variables include the temperature of the motor of the drive unit and/or wherein the status of ancillary equipment is used.

9. The method of claim 1, wherein, when computing said maximum permissible torque or maximum permissible power, a time-dependent delay or dead time component becomes effective when said operating variables change in the direction of lower torque or lower power.

10. The method of claim 1, the method comprising the further step of considering the motor rpm of the motor of said drive unit when computing said maximum permissible torque or said maximum permissible power in such a manner that a higher motor torque or higher power is permissible in the range of idle rpm or lower, a higher motor torque or a higher power is permissible than at higher motor rpms.

11. An arrangement for controlling the drive unit of a vehicle having an operator-controlled element, the arrangement comprising:

a sensor for supplying a signal indicative of a first operating variable defining the position of said operator-controlled element when the latter is actuated by the driver of the vehicle;

an electronic control unit for receiving said operating variable and at least one additional operating variable;

said electronic control unit being adapted to adjust the torque or power of said drive unit via an electrical path in dependence upon at least said first operating variable;

said electronic control unit being further adapted to determine the torque or the power of said drive unit in dependence upon at least one of said operating variables;

said electronic control unit including two microcomputers or one microcomputer having two mutually independent software modules;

said first microcomputer or said first program module being adapted to at least carry out the adjustment of said torque or power;

said second microcomputer or said second module being adapted to determine a maximum permissible torque and maximum permissible power; and, said second microcomputer or said second module being adapted to initiate a fault reaction when the computed torque and computed power exceed the maximum permissible torque and the maximum permissible power.

* * * * *

UNITED STATES PATENT AND TRADEMARK OFFICE

CERTIFICATE OF CORRECTION

PATENT NO. : 5,692,472
DATED : December 2, 1997
INVENTOR(S) : Frank Bederna, Martin Streib and Thomas Zeller It is certified that error appears in the above-indentified patent and that said Letters Patent is hereby corrected as shown below:

In column 5, line 10: delete "-engine" and substitute -- engine -- therefor.

In column 8, line 14: delete "and output power".

In column 8, line 20: delete "and power".

In column 8, line 23: delete "and a maxi-".

In column 8, line 24: delete "mum permissible power".

In column 8, line 26: delete "and".

In column 8, line 27: delete "power exceed" and substitute '-- exceeds -- therefor.

In column 8, line 27: delete "torque and" and substitute '-- torque. -- therefor.

In column 8, line 28: delete "said maximum permissible power".

In column 8, line 30: delete "or said maximum permissible power".

UNITED STATES PATENT AND TRADEMARK OFFICE

CERTIFICATE OF CORRECTION

PATENT NO. : 5,692,472
DATED : December 2, 1997
INVENTOR(S) : Frank Bederna, Martin Streib and Thomas Zeller It is certified that error appears in the above-indentified patent and that said Letters Patent is hereby corrected as shown below:

In column 8, line 33: delete "or said".

In column 8, line 34: delete "maximum permissible power".

In column 8, line 41: delete "and said".

In column 8, line 42: delete "power".

In column 8, line 45: delete "and said power".

In column 8, line 53: delete "torque or maximum permissible" and substitute -- torque, -- therefor.

In column 8, line 54: delete "power,".

In column 8, line 56: delete "torque or lower power." and substitute -- torque. -- therefor.

In column 8, line 60: delete "or said maximum permissible power".

In column 8, line 61: delete "or higher power".

In column 9, line 12: delete "or the power".

UNITED STATES PATENT AND TRADEMARK OFFICE

CERTIFICATE OF CORRECTION

PATENT NO. : 5,692,472
DATED : December 2, 1997
INVENTOR(S) : Frank Bederna, Martin Streib and Thomas Zeller It is certified that error appears in the above-indentified patent and that said Letters Patent is hereby corrected as shown below:

In column 10, line 6: delete "torque or power;" and substitute -- torque; -- therefor.

In column 10, line 7: delete "torque" and substitute -- torque; -- therefor.

In column 10, line 8: delete "and maximum permissible power;".

In column 10, line 12: delete "and computed power exceed" and substitute -- exceeds -- therefor.

In column 10, line 13: delete "torque and the maximum permissible" and substitute -- torque. -- therefor.

In column 10, line 14: delete "power.".

Signed and Sealed this

Twenty-eighth Day of July, 1998

Bruce Lehman

*Attest:*

BRUCE LEHMAN

*Attesting Officer*

*Commissioner of Patents and Trademarks*